United States Patent [19]

McCort

[11] 4,333,369

[45] Jun. 8, 1982

[54] APPARATUS AND METHOD FOR DIVIDING FIBROUS MINERAL BLANKETS

[75] Inventor: Ralph E. McCort, Newark, Ohio

[73] Assignee: Owens-Corning Fiberglas Corporation, Toledo, Ohio

[21] Appl. No.: 216,748

[22] Filed: Dec. 16, 1980

[51] Int. Cl.[3] ..... B26D 7/18

[52] U.S. Cl. ..... 83/24; 15/306 A; 83/100; 83/168; 134/15; 134/21

[58] Field of Search ..... 83/100, 24, 168; 15/306 A, 306 B; 134/15, 21, 64 R

[56] References Cited

U.S. PATENT DOCUMENTS

| | | | |
|---|---|---|---|
| 1,854,481 | 4/1932 | Mudd | 83/100 X |
| 2,824,610 | 2/1958 | Schubert et al. | 83/100 X |
| 3,020,687 | 2/1962 | Joa | 83/100 X |
| 3,272,651 | 9/1966 | Quirk | 15/306 A X |
| 4,003,276 | 1/1977 | Schmitt | 83/100 |
| 4,266,983 | 5/1981 | Laszlo et al. | 134/21 |

*Primary Examiner*—Frank T. Yost

*Attorney, Agent, or Firm*—Ronald C. Hudgens; Philip R. Cloutier; Ted C. Gillespie

[57] ABSTRACT

Apparatus for dividing a fibrous mineral blanket comprising means for slitting the blanket into batts, a suction chamber having one or more narrow openings adapted for contact with the side edges of the batts, and a vacuum pipe extending into the chamber for educting air and airborne particles from the chamber and the side edges of the batts, where the vacuum pipe has its eduction opening positioned near the bottom of the chamber.

11 Claims, 2 Drawing Figures

APPARATUS AND METHOD FOR DIVIDING FIBROUS MINERAL BLANKETS

TECHNICAL FIELD

This invention relates to apparatus for handling fibrous mineral blankets, and particularly blankets comprised of mineral fibers bonded together by a binder material to form a compressible body suitable for such purposes as insulation. In one of its more specific aspects, this invention relates to apparatus for slitting the fibrous mineral blanket into batts and removing the mineral fiber dust and other particulate material from the edges of the batts.

BACKGROUND OF THE INVENTION

The common practice in handling fibrous mineral blankets, particularly fibrous mineral blankets suitable for insulation purposes, is for the fibrous mineral blanket to be conveyed into contact with means such as a rotary saw for continuously slitting the fibrous mineral blanket into narrower strips, such as batts. Subsequent to the slitting process, the batts are commonly separated from each other by coming into contact with wedge-shaped spreaders. Thereafter, facing materials, such as kraft paper or foil, are usually applied separately to each batt in a continuous process. The batts are then cut into lengths and packaged.

One of the problems associated with such fiber handling processes is the problem of dust and particulate mineral fiber material generated by the slitting saws. Since the slitting process is continuous, and since the individual mineral fibers are fragile, large amounts of mineral dust are generated. The mineral fiber dust is often quite fine because the mineral fibers themselves can have an average diameter of about seven microns or less prior to the slitting step. The majority of the mineral fiber dust is retained at the side edges of the batts, and this has been found to be undesirable because the mineral fiber dust tends to foul apparatus in subsequent fabrication operations, such as in applying the facings to the batt, and in packaging the batts. Those who install the fibrous mineral products in their ultimate destinations, such as new housing construction, mobile homes or retrofit installations, find the presence of such a large amount of mineral fiber dust to be highly objectionable. Also, the slitter saws generate numerous tiny, loose insulation clumps, referred to as "puff balls," which adhere to the side edges of the batts and which are undesirable from a process and asthetic point of view. Additionally, the presence of mineral fiber dust particles during insulation fabrication processes create objectionable air pollution problems. There is a need for apparatus for effectively removing loose mineral fiber particles from the edges of the newly slit batts.

SUMMARY OF THE INVENTION

According to this invention, there is provided apparatus for dividing a fibrous mineral blanket of the type in which a fibrous mineral blanket is passed into contact with means for slitting the blanket into batts, where the improvement comprises a suction chamber having one or more narrow openings adapted for contact with the side edges of the batts, and a vacuum pipe extending into the chamber for educting air and airborne particles from the chamber and the side edges of the batts, where the vacuum pipe has its eduction opening positioned near the bottom of the chamber. The use of narrow openings which enable high velocity air passage therethrough while avoiding the tearing or grabbing of portions of the fibrous batt has been found to be effective in removing mineral dust in a continuous process.

In one embodiment of the invention, the eduction opening is positioned within the bottom 25 percent of the suction chamber.

In a preferred embodiment of the invention, the eduction opening is positioned within the bottom 10 percent of the suction chamber.

In another embodiment of the invention, the narrow openings are vertical.

In a preferred embodiment of the invention, the narrow openings have a height-width ratio within the range of from about 6 to about 15.

In the most preferred embodiment of the invention, the narrow openings have a height-width ratio of about 10.

In another preferred embodiment of the invention, the vertical edges of the narrow openings are inwardly beveled into the chamber.

In another embodiment of the invention, the apparatus comprises means for establishing a velocity across the openings within the range of from about 5.0 to about 8.3 meters per second.

In another embodiment of the invention, the suction chamber is positioned immediately downstream from means for separating the batts from each other.

According to this invention, there is also provided a method for dividing a fibrous mineral blanket of the type in which a fibrous mineral blanket is passed into contact with means for slitting the blanket into batts, wherein the improvement comprises contacting the side edges of the batts with one or more narrow openings of a suction chamber and removing particulate mineral material from the side edges of the batts by establishing an air velocity across the narrow openings within the range of from about 5.0 to about 8.3 meters per second.

In a preferred embodiment, an air velocity of about 6.5 meters per second is established across the narrow openings.

The invention will be described utilizing the embodiment of fibrous glass insulation blankets. It is to be understood, however, that the invention encompasses apparatus suitable for other fibrous mineral products.

DESCRIPTION OF THE INVENTION

Figures 1, 2:
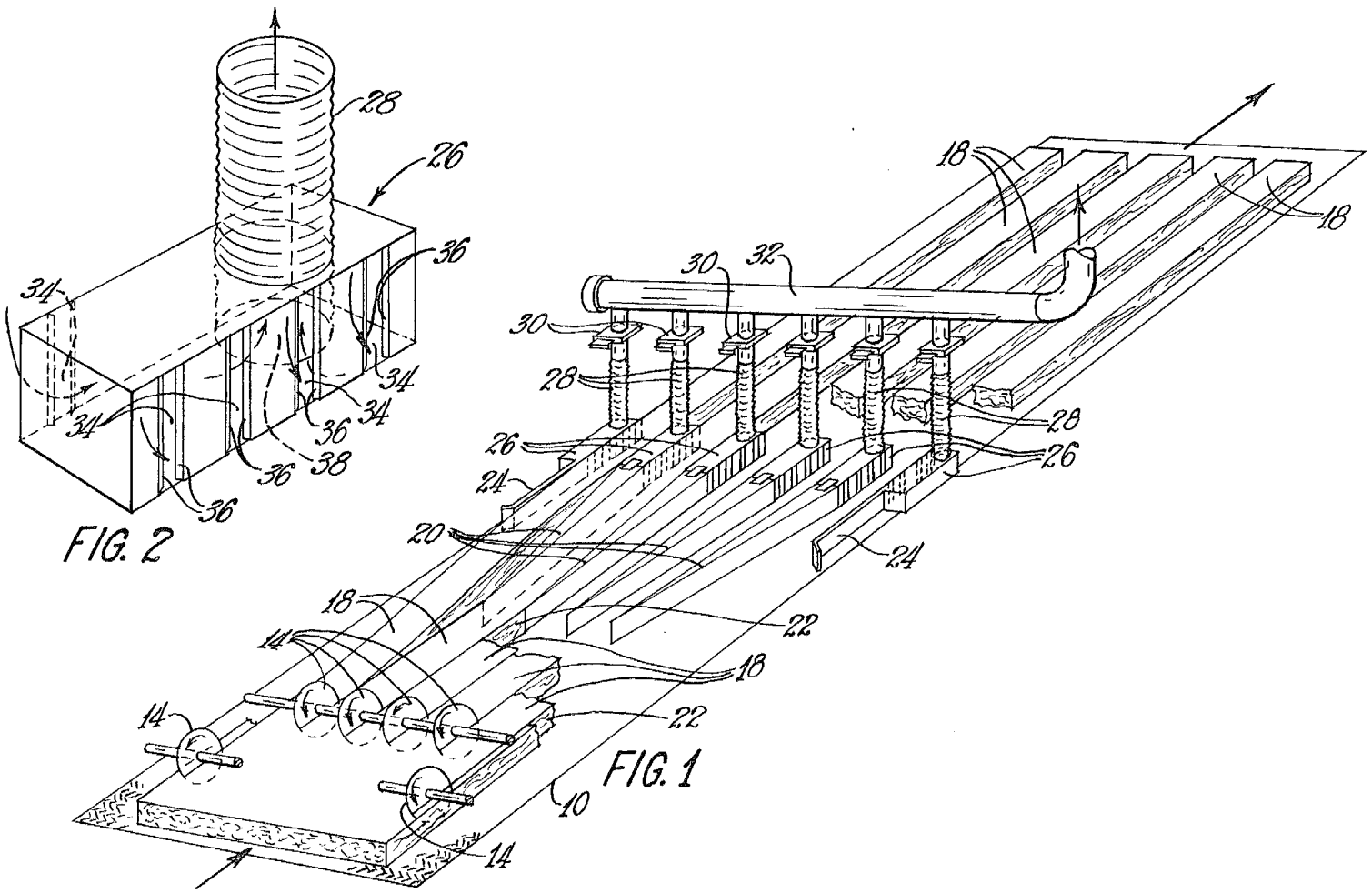
FIG. 1 is a schematic view in perspective of apparatus for dividing fibrous mineral blankets into batts according to the principles of this invention.
FIG. 2 is a schematic view in perspective of the suction box of the apparatus of FIG. 1.

As shown in FIG. 1, conveyor 10 is adapted to continuously carry glass fiber insulation blanket 12 into contact with edge trim saws 14 and slitter saw 16. The slitter saw divides the blanket into batts 18 which can be separated from each other by any suitable means such as wedge-shaped spreader bars 20. The slitter saw and edge trim saws, which can be rotary saws as shown, generate mineral fiber particulate material, such as dust and puff balls, which adheres to side edges 22 of the batts. Side guides 24 can be used in conjunction with the spreader bars to properly align the batts.

Subsequent to the slitting step, the batts are passed into contact with suction chambers 26. Preferably, the suction chambers are mounted immediately downstream from the spreader bars and side guides. The suction chambers are maintained with a partial vacuum via the particulate material removal network comprised of vacuum pipes 28, blast gates 30 for controlling the vacuum in each suction chamber, and manifold 32 which is connected to a suitable suction means, not shown. Contact between the suction chambers and the side edges of the batts causes the particulate material on the side edges of the batts to enter the suction chambers, and be drawn upwardly through the vacuum pipes, through the manifold and to a collection point, not shown.

As shown in FIG. 2, the suction chamber contains one or more narrow openings, such as slots 34. An important aspect in the removal of particulate material from the side edges of the batts is the velocity of the moving air by which the particulate material is to be removed. The blast gates are adjusted to control the suction through the vacuum pipe so that an air velocity within the range of from about 5.0 to about 8.3 meters per second is established across the slots. Preferably, an air velocity of about 6.5 meters per second is established. The velocity requirement to remove the particulate material must be satisfied by the use of the narrow slots in order to avoid tearing or grabbing of the batts. It has been found that the slots should have a height-width ratio within the range of from about 6 to about 15, and preferably they should have a height-width ratio of about 10. Preferably, the slots are vertical. Vertical edges 36 of the slots can be beveled inwardly into the chamber to facilitate the smooth passing of the side edges of the batt in close contact with the suction chamber without causing any of the fibrous material to hang up on the edges of the slot.

As shown by the arrows, in FIG. 2, air and airborne particulate material enter the suction chamber by being drawn generally downwardly through the slots and are withdrawn from the suction chamber via vacuum pipe opening 38 of the vacuum pipe. The vacuum pipe opening is positioned within the bottom 25 percent of the height of the suction chamber, and, preferably, within the bottom 10 percent of the suction chamber. This insures that the flow of air through the slots will have a predominantly downward direction, since the vacuum pipe opening is positioned at such a low point in the suction chamber. The downward movement of air and particulate material through the slots is desirable because the short circuiting of air through the upper portion of the insulation batt is thereby minimized.

INDUSTRIAL APPLICABILITY

This invention will be found to be useful in the slitting and fabrication of fibrous mineral blankets for such uses as glass fiber thermal insulation products and glass fiber acoustical insulation products.

I claim:

1. Apparatus for dividing a fibrous mineral blanket of the type in which a fibrous mineral blanket is passed into contact with means for slitting the blanket into batts, wherein the improvement comprises a suction chamber having one or more narrow openings adapted for contact with said side edges of said batts, and a vacuum pipe extending into said chamber for educting air and airborne particles from said chamber and said side edges of said batts, said vacuum pipe having its eduction opening positioned near the bottom of said chamber.

2. The apparatus of claim 1 in which said eduction opening is positioned within the bottom 25 percent of said suction chamber.

3. The apparatus of claim 2 in which said opening is positioned within the bottom 10 percent of said suction chamber.

4. The apparatus of claim 2 in which said narrow openings are vertical.

5. The apparatus of claim 4 in which said narrow openings have a height-to-width ratio within the range of from about 6 to about 15.

6. The apparatus of claim 5 in which said narrow openings have a height-to-width ratio of about 10.

7. The apparatus of claim 6 in which the vertical edges of said narrow openings are inwardly beveled into said chamber.

8. The apparatus of claim 7 comprising means for establishing a velocity across said openings within the range of from about 5.0 to 8.3 meters per second.

9. Apparatus for dividing a fibrous mineral blanket of the type in which a fibrous mineral blanket is passed into contact with means for slitting the blanket into batts and subsequently passed into contact with means for separating said batts from each other, wherein the improvement comprises suction chambers having one or more vertical openings having a height-to-width ratio of about 10 and being adapted for contact with the side edges of said batts, vacuum pipes extending into said chambers for educting air and airborne particles from said chambers and said side edges of said batts, said vacuum pipes having their eduction openings positioned within the bottom 25 percent of said chambers, and blast gates for establishing a velocity across said openings within the range of from about 5.0 to about 8.3 meters per second.

10. A method for dividing a fibrous mineral blanket of the type in which a fibrous mineral blanket is passed into contact with means for slitting the blanket into batts, wherein the improvement comprises contacting the side edges of said batts with one or more narrow openings of a suction chamber, said narrow openings having a height-width ratio within the range of from about 6 to about 15, and removing particulate mineral material from said side edges of said batts by establishing an air velocity across said narrow openings within the range of from about 5.0 to about 8.3 meters per second.

11. The method according to claim 10 comprising establishing an air velocity of about 6.5 meters per second across said narrow openings.

* * * * *